United States Patent [19]

Venetta et al.

[11] 4,108,594

[45] Aug. 22, 1978

[54] METHOD FOR FUEL/AIR FEED PRESSURE CONTROL BY STACK TEMPERATURE

[75] Inventors: Henry John Venetta, Warren; Raymond Edward Singrey, Williamsfield; John Edward Coughlin, Youngstown, all of Ohio

[73] Assignee: Venetta, Inc., Warren, Ohio

[21] Appl. No.: 748,131

[22] Filed: Dec. 6, 1976

[51] Int. Cl.[2] ..... F27D 7/00

[52] U.S. Cl. ..... 432/24; 236/15 BD

[58] Field of Search ..... 432/24, 36, 54; 236/15 BR, 15 BD, 15 BE

[56] References Cited

U.S. PATENT DOCUMENTS

| | | | |
|---|---|---|---|
| 2,293,550 | 8/1942 | Kells | 236/15 BD |
| 3,689,041 | 9/1972 | Pere et al. | 432/24 |
| 3,721,519 | 3/1973 | Venetta | 432/88 |
| 3,813,209 | 5/1974 | Venetta | 432/11 |

*Primary Examiner*—John J. Camby

*Attorney, Agent, or Firm*—Oldham, Oldham, Hudak & Weber Co.

[57] ABSTRACT

This metal heating method includes burning an air-gas fuel mixture as it flows into a furnace, flowing hot exhaust gases out of the furnace to an exhaust stack after it has impinged on or been brought into association with the metal in the furnace for heating the same, and thereafter measuring the temperature of gases in the stack. This gas temperature is used for controlling the pressure of the air and also of the gas fuel supplied to the furnace for combustion and with the pressure supplied being reduced when temperatures excessive to predetermined temperatures exist in the stack, but at the same time, a desired high fuel-to-air ratio is maintained to provide a reducing atmosphere in the furnace.

3 Claims, 1 Drawing Figure

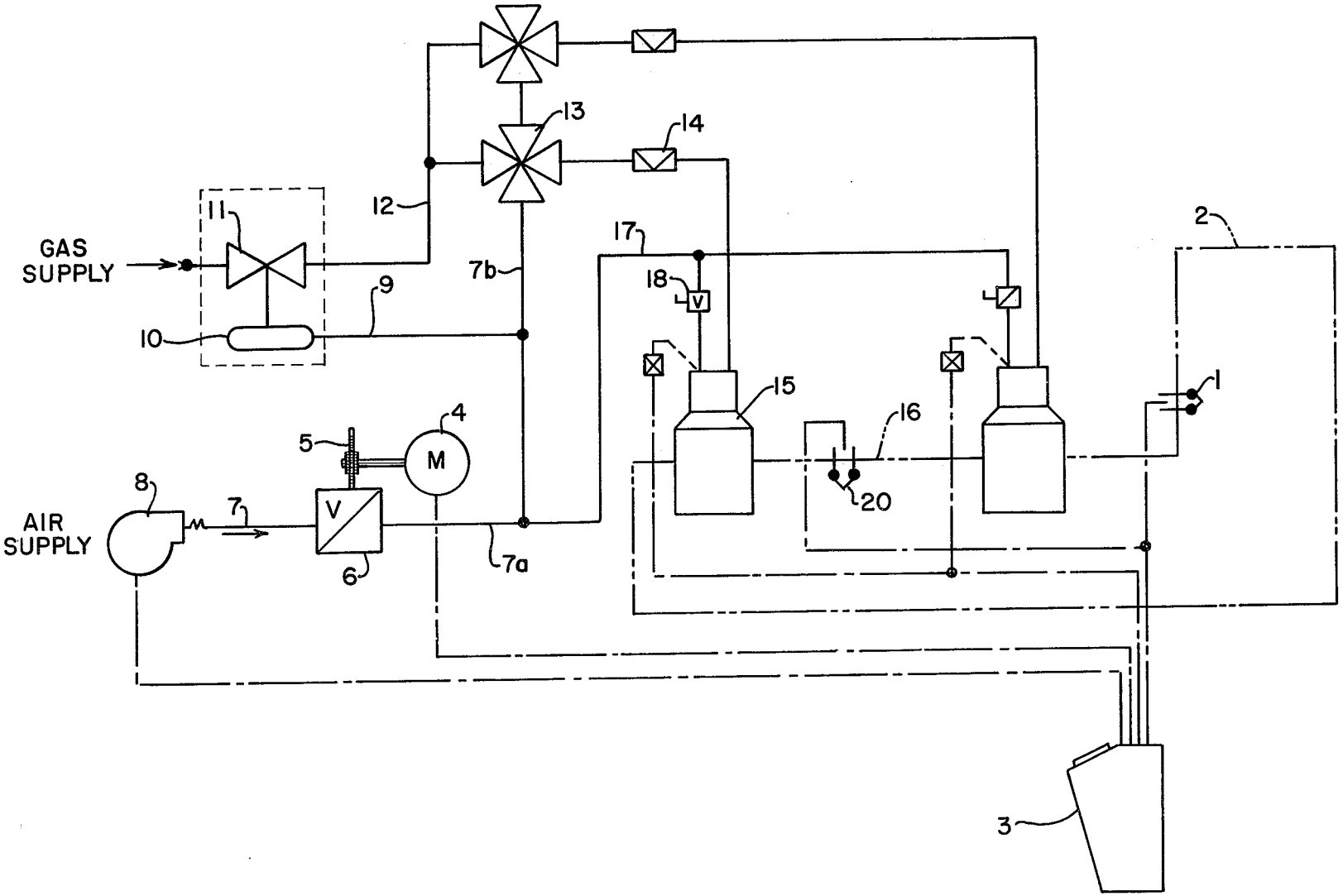
GAS SUPPLY
AIR SUPPLY
M
V
1
2
3
4
5
6
7
7a
7b
8
9
10
11
12
13
14
15
16
17
18
20

METHOD FOR FUEL/AIR FEED PRESSURE CONTROL BY STACK TEMPERATURE

BACKGROUND OF THE INVENTION

Heretofore there have been a number of different types of preheating apparatus provided for metal such as metal scrap which is to be processed in furnaces for metal manufacture or which is to be used for other purposes.

Previously U.S. Pat. No. 3,721,519 on "Furnace Charging Apparatus", and U.S. Pat. No. 3,813,209 on the "Preheating of Metal Scrap" have been obtained. The apparatus and the functioning thereof as described in these patents have provided very satisfactory metal preheating actions. Both patents teach use of afterburners in the exhaust gases, and U.S. Pat. No. 3,813,209 teaches reducing the fuel burners to a low fire setting after the metal has reached a desired temperature. It naturally is desirable to preheat metal masses as efficiently as possible, and to preheat such metal scrap masses quickly by use of minimum quantities of fuel.

It is well known that when scrap metal is being heated, it can receive, store and transfer heat at a rate based upon its absorptivity. As this absorptivity decreases as the temperature of the metal increases, the time required for raising the heat from a particular point or temperature (dependent upon the material and initial temperatures involved) to a desired temperature about ⅓ higher than this point, is equal to the time required for the first increase in temperature from, for example, ambient temperatures to the particular starting temperature for the latter increase.

For best heat transfer action, it is necessary to maintain a positive temperature differential and as much direct flame impingement on the material as is possible. Hence, it is believed that if extra heat is suplied to the material in the preheater hood or furnace, it will not be absorbed and such extra heat can be sensed leaving the preheater hood or furnace via the exhaust stack and connecting means.

The general object of the general invention is to provide an improved method for preheating metal scrap or the like in a furnace by control of the fuel supply to the furnace, and characterized by control of the air-fuel supply pressure dependent upon the temperature of the gases exhausting from the furnace.

Another object of the invention is to regulate the pressure of a gaseous fuel to be supplied to a furnace or preheater hood to make it equal or substantially equal to the air pressure supplied to such hood, and is also to control, automatically, the air pressure supplied to the hood in relation to the temperature of exhaust gases leaving the hood, whereby if such exhaust gases are at an excessive temperature, the pressure of the air and fuel supplied to the preheater hood or furnace are reduced.

A further object of the invention is to provide for automatically efficiently utilizing fuel supplied to a metal preheater hood or furnace to prevent excessive fuel supply thereto and consequent excessive temperatures and exhaust gases due to a minimum removal of heat transfer to the processed material while in the preheater hood.

The foregoing and other objects and advantages of the invention will be made more apparent as the specification proceeds.

Reference now is particularly made to the accompanying drawing which is a diagrammatic showing of apparatus relating to the invention and utilizing apparatus for practicing the method of the invention.

When referring to corresponding members shown in the drawings and referred to in the specification, corresponding numerals are used to facilitate comparison therebetween.

SUBJECT MATTER OF INVENTION

The method of heating metal in a preheater hood or furnace of the invention comprises, as one embodiment thereof, the burning of a compressed air-fuel mixture in a furnace or preheater hood, impinging the burning mixture on the metal, flowing the hot exhaust gases from the furnace, measuring the temperature of the exhaust gases and comparing it to a predetermined standard, controlling the pressure of the fuel-air mixture supplied the furnace depending upon the exhaust gases temperature, and reducing the pressure of such mixture when excessive temperature conditions exist in the exhaust gases. The invention further comprises independently regulating the air pressure transmitted to the burner depending upon the exhaust gas temperature and regulating the pressure of the gas fuel material supplied by the air pressure to make the pressures equal or coordinated to maintaining a constant air-fuel ratio at the burner so that an excessive fuel-to-air ratio can be maintained at all times, if desired.

The air-fuel pressure control system of the invention includes a control thermocouple 1 that senses the temperature in the exhaust stack 2. The thermocouple then passes its electrical signal, based on the temperature registered, to a control console 3. This control console includes a Honeywell indicating position proportioning temperature controller, or similar apparatus, and which controller in this instance had a range of from 0° to 2,000° F., and which in turn transmits an electrical signal based on the stack temperature to a modulating motor 4. This motor 4 is of an impulse drive type with position feedback signal and is mechanically coupled to and rotates the control shaft 5 of a butterfly valve 6 through a controlled arc. The valve 6 is positioned in an air supply tube or line 7 that receives a stream of compressed air from a suitably driven compressor-blower 8. As this valve 6 is opened or closed, and with normally the valve being reduced in its open area when the temperature measured in the stack 2 is indicated as being too high in relation to a predetermined norm, then this change in the air pressure that is transmitted through the line 7 at a portion **7*a* thereof is measured or transmitted by another tube 9 that connects over to a conventional gas pressure regulator 10. This gas pressure regulator 10 has a diaphragm therein controlling an associated movable valve 11 of a conventional nature whereby as the air pressure transmitted through the valve 6 varies up and down and such pressure is transmitted through the tube 9 to the regulator 10, the gas pressure flowing through the valve 11 is thus increased or decreased proportionately to or the same as any change in pressure in the line 7*a*. Hence, the gas pressure is varied so as to match or be proportional to the air pressure to maintain a constant air-to-gas ratio throughout the operational range of the proportioning temperature controller provided in the console 3. The gas flows through a tube or line 12 and usually through conventional members such as a shut-off cock 13 and then through a limiting orifice gas valve 14 to a high velocity nozzle mix burner 15 that extends into the preheat hood or furnace 16**. Air from the line *7a* flows through a connector line 17 to the individual burners 15 provided in longitudinally spaced portions of the hood or furnace 16. Such air may flow through a control valve 18 to reach the burner 15. Air also flows from the line *7a* by a line *7b* to the shut-off cock 13.

Thus, by the invention, the electrical signal taken from the thermocouple 1 is transmitted to the console 3 for regulating, through the proportioning temperature controller, the drive and positioning of the motor 4 which by the positioning of its output shaft or associated drive means controls the accurate position of the shaft 5 of the butterfly valve 6 to regulate its position in relation to the temperature in the stack. Hence, if excessive heat has been applied to the metal in the preheat hood or furnace 16, such heat loss is reflected by increased temperature conditions in the stack 2 as the metal in the hood has not cooled the furnace gases and this requires a reduction in the pressure of the fuel-air mixture supplied to the nozzle 15. This in turn will reduce the temperature or operating conditions in the preheat hood to obtain more efficient use of fuel and heat supplied to the preheat hood for preheating metal for further processing.

The preheat hood of the invention usually has a high heat supply and an alternate low heat supply provided to it by the gas-air volume supplied. And such fuel volume supply may be controlled by known high heat fuel-air mix for desired lengths of time during preheat cycles.

Note that the controller 3 only functions during the time that the high heat timer is energized. At all other times the modulating motor drives the air valve 6 almost closed and the flame cuts back to a predetermined low level of heat.

The fuel-air ratio used in a scrap preheating is important due to the eroding effects of iron oxide from oxidized scrap on the refractory lining of induction furnaces which are those frequently used with preheated metal by this invention. This ratio control system herein described is adjusted to maintain a slightly rich atmosphere throughout the heating cycle, thus minimizing the oxidation.

Exhaust gas temperatures can be measured in the stack or in the conduit flue leading to the stack as the thermocouple may be either of such locations. An auxiliary thermocouple 20 is inserted through the refractory lining and extends into the furnace 16 in such a location as to avoid mechanical damage and direct burner flame impingement, thus measuring furnace temperature. Such thermocouple can be used for control action rather than as a reference temperature indicator if ambient flue conditions prevent consistent control from the exhaust flue or stack.

The high heat timer is usually manually controlled and is part of the controller in the control console 3. The position of the shaft 5 of the valve 6 is accurately controlled through linkage with the modulating motor 4 and the motor 4 sends a signal back to the controller based on the valve position to aid in regulating valve opening position to be that required by the then temperature of the exhaust gases.

While one complete embodiment of the invention has been disclosed herein, it will be appreciated that modification of this particular embodiment of the invention may be resorted to without departing from the scope of the invention.

What is claimed is:

1. A method of heating metal in a furnace comprising burning a compressed air and gaseous fuel mixture in a furnace and thereby heating the metal, flowing the hot exhaust gases to an exhaust stack, measuring the temperature of the gases as they are being exhausted, automatically controlling the pressure of the fuel-air mixture supplied to the furnace dependent upon the exhaust gas temperature, and reducing the pressure when excessive temperatures exist in the exhaust gas but maintaining a constant excessive fuel-to-air ratio at all times to provide a reducing atmosphere in the furnace.

2. A method of heating metal as in claim 1 where a stream of compressed air is provided for the burner, regulating the air pressure transmitted to the burner by making such pressure inversely proportional to the exhaust gas temperature, transmitting the air pressure being supplied to the burner, to a gas fuel supply line for the burner and regulating the pressure of gas suplied by the air pressure supplied so as to make it equal to the air pressure to maintain a constant air-fuel ratio at said burner but whereby the air-fuel mixture pressure at the burner can vary under control of the exhaust gas temperature.

3. A method of heating metal in a furnace comprising burning a compressed air fuel mixture in a furnace and impinging the burning mixture on the metal, flowing the hot exhaust gases from the furnace, measuring the temperature of exhaust gases in the exhaust stack, controlling the pressure of the fuel-air mixture supplied to the furnace dependent upon the exhaust gases temperature and reducing the pressure when excessive temperature conditions exist in the gases, and where a stream of compressed air is provided for a burner in the furnace, controlling the air pressure transmitted to the burner depending upon and making such pressure proportional to the exhaust gas temperature, utilizing a gaseous fuel material in the furnace, and using the controlled air pressure for regulating the pressure of gas-fuel material supplied so as to make it equal to the air pressure to maintain a constant air-fuel ratio at said burner but whereby the air-fuel pressure at the burner can vary under control of the furnace exhaust gas temperature.

* * * * *